US007911435B2

(12) United States Patent
Chen

(10) Patent No.: US 7,911,435 B2
(45) Date of Patent: Mar. 22, 2011

(54) DISPLAY AND SOURCE DRIVER THEREOF

(75) Inventor: Ping-Po Chen, Sinshih Township (TW)

(73) Assignee: Himax Technologies Limited, Sinshih Township (TW)

( * ) Notice: Subject to any disclaimer, the term of this patent is extended or adjusted under 35 U.S.C. 154(b) by 1028 days.

(21) Appl. No.: 11/692,318

(22) Filed: Mar. 28, 2007

(65) Prior Publication Data

US 2008/0238851 A1 Oct. 2, 2008

(51) Int. Cl.
*G09G 3/36* (2006.01)

(52) U.S. Cl. ..... 345/98; 345/204

(58) Field of Classification Search ..... None
See application file for complete search history.

(56) References Cited

U.S. PATENT DOCUMENTS

| | | | | |
|---|---|---|---|---|
| 5,523,706 | A * | 6/1996 | Kiani et al. | 326/41 |
| 6,304,241 | B1 * | 10/2001 | Udo et al. | 345/96 |
| 6,518,708 | B2 | 2/2003 | Aso | |
| 6,658,509 | B1 * | 12/2003 | Bonella et al. | 710/100 |
| 6,864,873 | B2 | 3/2005 | Yamagata et al. | |
| 6,885,358 | B2 * | 4/2005 | Anh | 345/98 |
| 7,511,691 | B2 | 3/2009 | Hirayama et al. | |
| 2005/0024315 | A1 * | 2/2005 | Yamagata et al. | 345/98 |
| 2006/0098032 | A1 * | 5/2006 | Nakahira et al. | 345/690 |

FOREIGN PATENT DOCUMENTS

| | | | |
|---|---|---|---|
| CN | 1350279 | A | 5/2002 |
| TW | 552572 | B | 9/2003 |
| TW | 569179 | B | 1/2004 |
| TW | 263970 | B | 10/2006 |

* cited by examiner

*Primary Examiner* — Amare Mengistu
*Assistant Examiner* — Antonio Xavier

(57) ABSTRACT

A pixel circuit has a light emitting diode, a first driving transistor, a second driving transistor, a capacitor, and a switch unit. When a scan signal is asserted, the switch unit couples sources/drains of the second driving transistor respectively to a first and a second source/drain of the first driving transistor, and couples a gate and second source/drain of the first driving transistor together. When the scan signal is de-asserted, the switch unit decouples one of the sources/drains of the second driving transistor from the first/second source/drain of the first driving transistor, and decouples the gate from the second source/drain of the first driving transistor.

10 Claims, 4 Drawing Sheets

| | S1 | S2 | S3 | S4 | S5 | S6 | S7 | S8 |
|---|---|---|---|---|---|---|---|---|
| G1 | + | − | + | − | + | − | + | − |
| G2 | − | + | − | + | − | + | − | + |
| G3 | + | − | + | − | + | − | + | − |
| G4 | − | + | − | + | − | + | − | + |
| G5 | + | − | + | − | + | − | + | − |
| G6 | − | + | − | + | − | + | − | + |
| G7 | + | − | + | − | + | − | + | − |
| G8 | − | + | − | + | − | + | − | + |

Fig. 1A (prior art)

DISPLAY AND SOURCE DRIVER THEREOF

BACKGROUND

1. Field of Invention

The present invention relates to a display, and more particularly relates to a source driver of the display.

2. Description of Related Art

In order to avoid image sticking, the polarity of each pixel of the display should not be consistent for a long time. There are many kinds of polarity distribution, for example the one-dot-line inversion shown in FIG. 1A. The display operates according to data lines S1~S8 and gate lines G1~G8. The symbol '+' represents the pixel has a positive polarity, and the symbol represents the pixel has a negative polarity.

FIG. 1B is a block diagram of a source driver for the display. The source driver has a sample/hold circuit 110, multiplexers (MUX) 150*a*, 150*b* and 160, a low voltage operational amplifier (LV OPA) 130, and a high voltage operational amplifier (HV OPA) 140, for driving data lines, for example S1 and S2.

The sample/hold circuit 110 receives a positive polarity voltage $VA^+$ and a negative polarity voltage $VA^-$ of a first signal for outputting a first sampled-held voltage SH1 and a second sampled-held voltage SH2. And, the sample/hold circuit 110 receives a positive polarity voltage $VB^+$ and a second polarity voltage $VB^-$ of a second signal for outputting a third sampled-held voltage SH3 and a fourth sampled-held voltage SH4.

The low voltage operational amplifier 130 amplifies the first sampled-held voltage SH1 or the third sampled-held voltage SH3 selectively output by the multiplexer 150*a* and outputs a low pixel voltage LP with a negative polarity. The high voltage operational amplifier 140 amplifies the second sampled-held voltage SH2 or the fourth sampled-held voltage SH4 selectively output by the multiplexer 150*b* to output a high pixel voltage HP with a positive polarity. The multiplexer 160 output the low pixel voltage LP and the high pixel voltage HP to data lines S1 and S2 of the display according to the polarity signal POL.

The sample/hold circuit 110 has a first capacitor device 114*a* and a second capacitor device 118*a* to respectively deal with the positive polarity voltage $VA^+$ and the negative polarity voltage $VA^-$ of the first signal. Moreover, the sample/hold circuit 110 has a third capacitor device 114*b* and a fourth capacitor device 118*b* to respectively deal with the positive polarity voltage $VB^+$ and the negative polarity voltage $VB^-$ of the second signal. That is, the source driver needs at least four capacitor devices to drive two data lines.

SUMMARY

According to one embodiment of the present invention, the source driver for driving a display panel has a sample/hold circuit, a first multiplexer, a first low voltage amplifier, a high voltage amplifier device, and a second multiplexer. The sample/hold circuit has two inputs for receiving a first voltage and a second voltage and two outputs for outputting a first sampled-held voltage and a second sampled-held voltage. The first multiplexer has two inputs respectively connected to the outputs of the sample/hold circuit, and has two outputs for respectively outputting the first sampled-held voltage and the second sampled-held voltage selectively according to a polarity signal. The first low voltage amplifier connects to one output of the first multiplexer to output a low pixel voltage. The high voltage amplifier device connects to the other output of the first multiplexer to output a high pixel voltage. The second multiplexer respectively outputs the low pixel voltage and the high pixel voltage to two data lines of the display panel according to the polarity signal.

According to another embodiment of the present invention, the source driver for driving a display panel has a sample/hold circuit, a first low voltage amplifier, a second low voltage amplifier, a first multiplexer, a high voltage amplifier, a second multiplexer, and a third multiplexer. The sample/hold circuit receives a first voltage and a second voltage and outputs a first sampled-held voltage and a second sampled-held voltage. The first low voltage amplifier receives the first sampled-held voltage and generates a first low pixel voltage within a low-voltage range. The second low voltage amplifier receives the second sampled-held voltage and generates a second low pixel voltage within the low-voltage range. The first multiplexer has one output for outputting one of the first low pixel voltage and the second low pixel voltage according to a polarity signal. The high voltage amplifier connects to the output of the first multiplexer and generates a high pixel voltage within a high-voltage range. The second multiplexer outputs one of the first low pixel voltage and the high pixel voltage to a first data line of the display panel according to the polarity signal. The third multiplexer outputs one of the second low pixel voltage and the high pixel voltage to a second data line of the display panel according to the polarity signal.

According to another embodiment of the present invention, the display has a display panel and a source driver for driving a display panel. The source driver has a sample/hold circuit and an amplifier device. The sample/hold circuit has a first capacitor device and a second capacitor device. The first capacitor device generates a first sampled-held voltage based on a first voltage. The second capacitor device generates a second sampled-held voltage based on a second voltage. The amplifier device selects one of the first sampled-held voltage and the second sampled-held voltage to be high-voltage amplified as a high pixel voltage, and selects the other to be low-voltage amplified as a low pixel voltage according to a polarity signal. The amplifier device further respectively outputs the low pixel voltage and the high pixel voltage to two data lines of the display panel according to the polarity signal.

It is to be understood that both the foregoing general description and the following detailed description are by examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

FIG. 1A shows a polarity distribution of a pixel array;

DESCRIPTION OF THE PREFERRED EMBODIMENTS

Figure 1B:
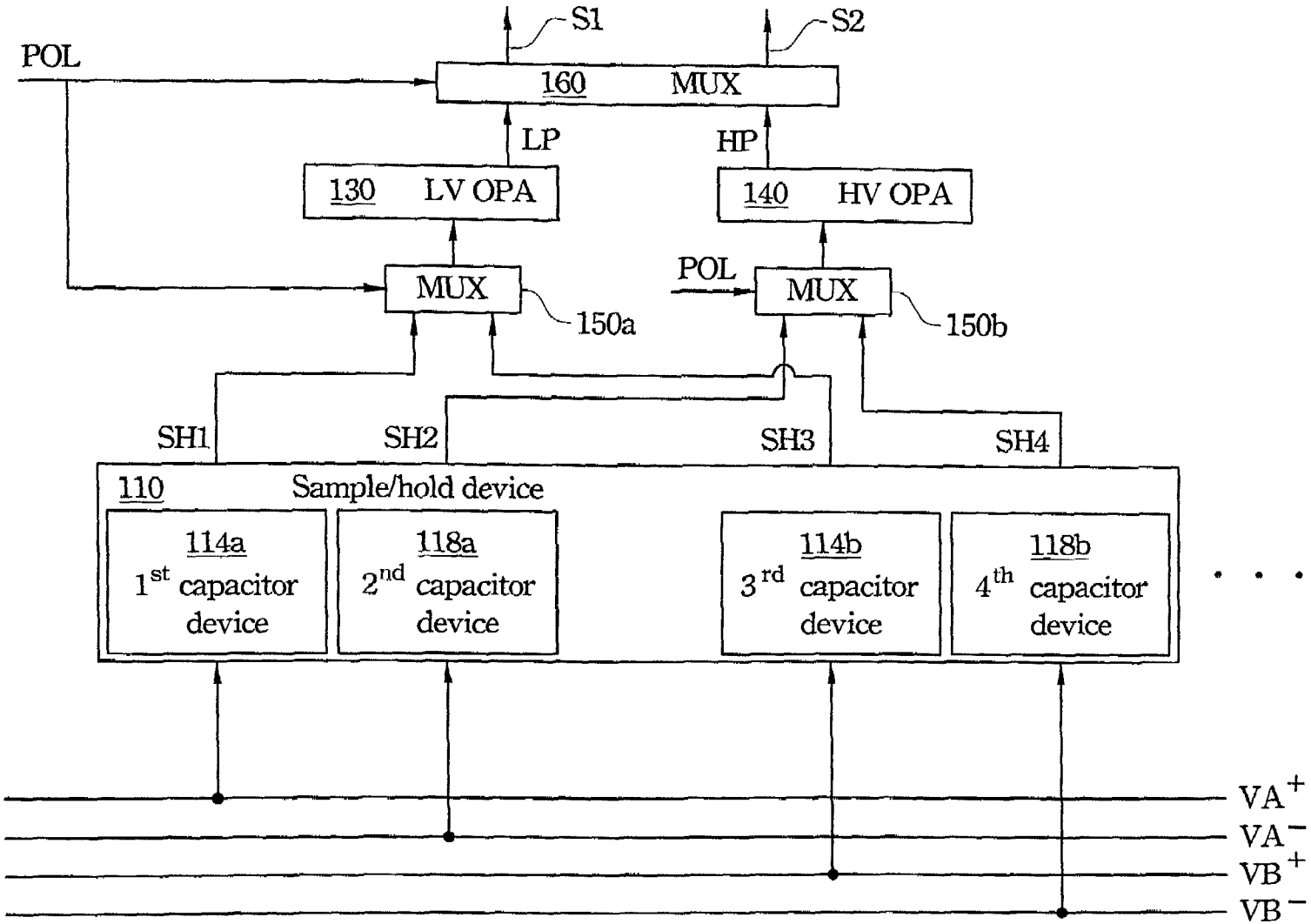
Fig. 1B (prior art)
FIG. 1B shows a source driver of the prior art.

Reference will now be made in detail to the present preferred embodiments of the invention, examples of which are illustrated in the accompanying drawings. Wherever possible, the same reference numbers are used in the drawings and the description to refer to the same or like parts.

Figure 2:
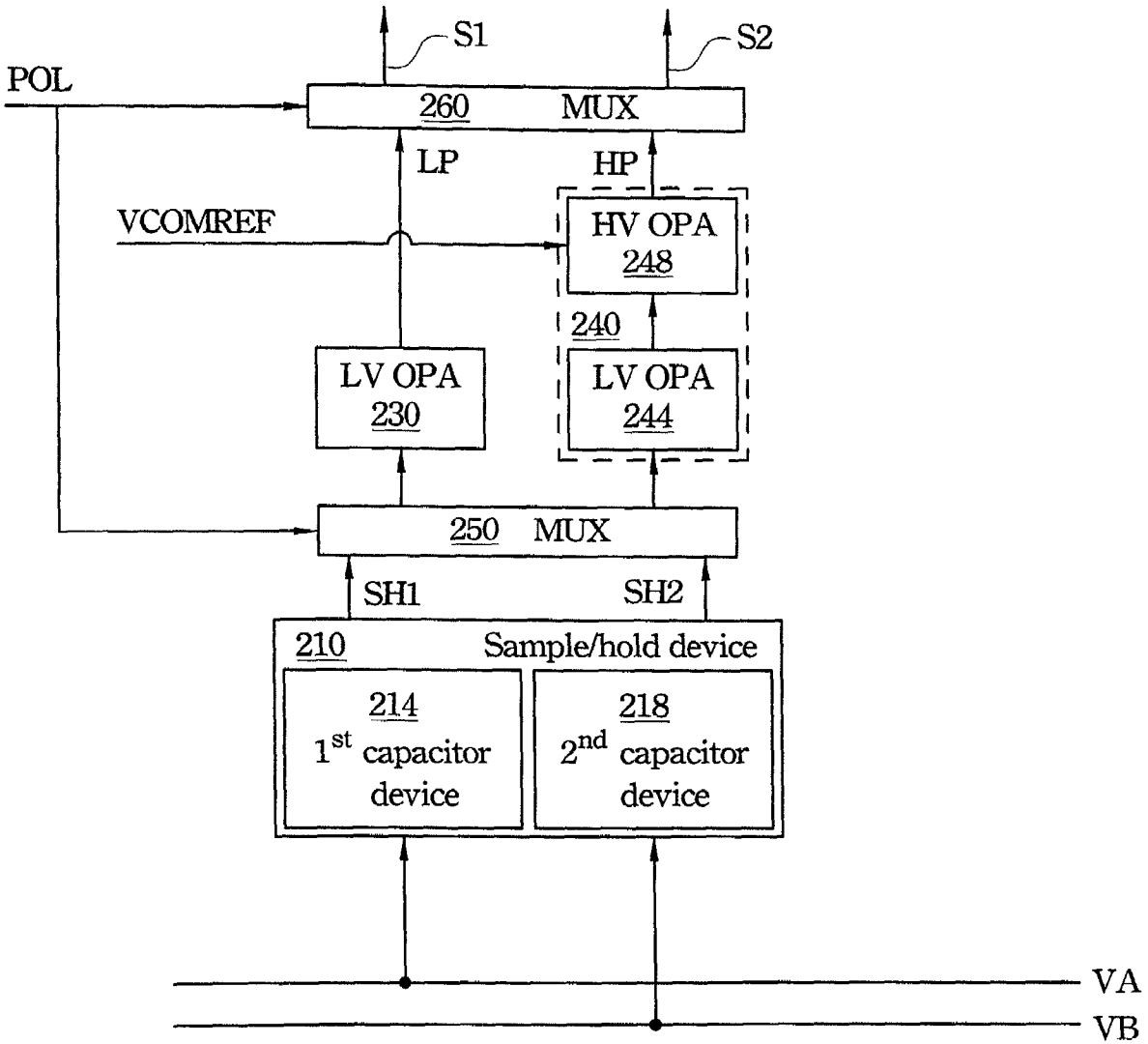
FIG. 2 shows a source driver according to an embodiment of the invention.

FIG. 2 is a block diagram of a source driver according to an embodiment of the invention. The source driver has a sample/hold circuit 210, a first multiplexer (MUX) 250, a first low voltage operational amplifier (LV OPA) 230, a high voltage amplifier device 240, and a second multiplexer (MUX) 260. The sample/hold circuit 210 has two inputs for receiving a first signal VA and a second signal VB and two outputs for outputting a first sampled-held voltage SH1 and a second sampled-held voltage SH2. The first multiplexer (MUX) 250 has two inputs respectively connected to the outputs of the sample/hold circuit 210, and has two outputs for respectively outputting the first sampled-held voltage SH1 and the second sampled-held voltage SH2 according to a polarity signal POL.

The first low voltage operational amplifier 230 connects to one output of the first multiplexer 250 to output a low pixel voltage LP with a negative polarity. The high voltage amplifier device 240 connects to the other output of the first multiplexer 250 to output a high pixel voltage HP with a positive polarity. The second multiplexer 260 output the low pixel voltage LP and the high pixel voltage HP selectively to data lines S1 and S2 of the display according to the polarity signal POL. The polarity signal POL is determined by the polarity distribution.

Moreover, the low pixel voltage LP is lower than a common voltage VCOMREF, and the high pixel voltage HP is higher than the common voltage VCOMREF. The common voltage VCOMREF is the reference voltage to determine the polarity of the pixel voltages.

The sample/hold circuit 210 has a first capacitor device 214 and a second capacitor device 218. The first capacitor device 214 generates the first sampled-held voltage SH1 based on the first signal VA. The second capacitor device 218 generates the second sampled-held voltage SH2 based on the second signal VB.

When the polarity signal POL is a first value (such as a value represents a positive polarity), the first multiplexer 250 outputs the first sampled-held voltage SH1 to the first low voltage operational amplifier 230 and outputs the second sampled-held voltage SH2 to the high voltage amplifier device 240. When the polarity signal POL is a second value (such as a value represents a negative polarity), the first multiplexer 250 outputs the first sampled-held voltage SH1 to the high voltage amplifier device 240 and outputs the second sampled-held SH2 voltage to the first low voltage operational amplifier 230.

The high voltage amplifier device 240 has a second low voltage operational amplifier (LV OPA) 244 receiving the output from the first multiplexer 250, and a high voltage operational amplifier (HV OPA) 248 connecting to the second low voltage operational amplifier 244 in series to generate the high pixel voltage HP.

The high voltage operational amplifier 248 generates the high pixel voltage HP based on an output from the second low voltage operational amplifier 244 and the common voltage VCOMREF. Namely, the high pixel voltage HP is generated from the output of the second low voltage operational amplifier 244 and is higher than the common voltage VCOMREF.

Figure 3:
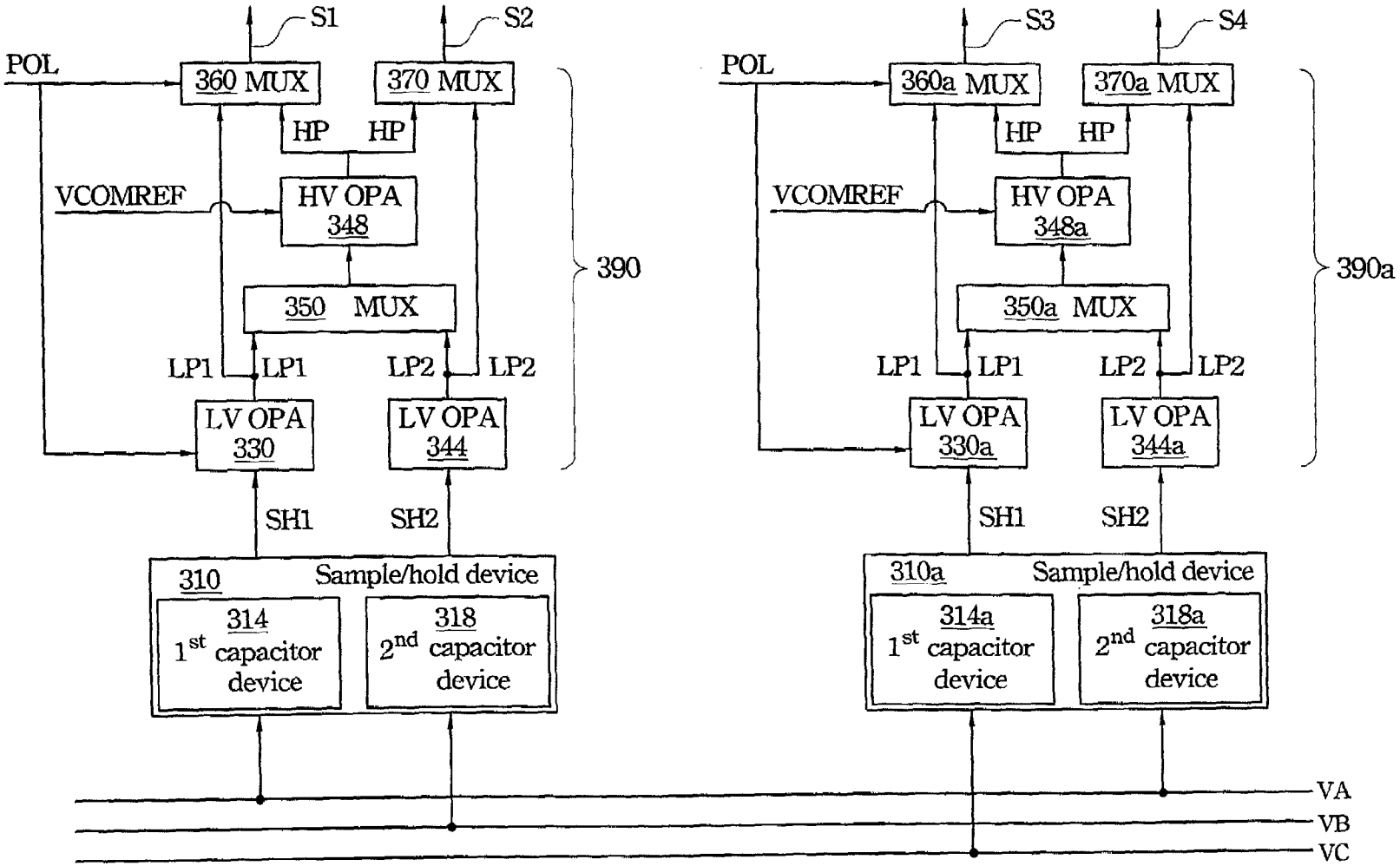
FIG. 3 shows a source driver according to another embodiment of the invention.

FIG. 3 is a block diagram of a source driver according to another embodiment of the invention. The source driver for driving a display has a sample/hold circuit 310, a first low voltage operational amplifier (LV OPA) 330, a second low voltage operational amplifier (LV OPA) 344, a first multiplexer (MUX) 350, a high voltage operational amplifier (HV OPA) 348, a second multiplexer (MUX) 360, and a third multiplexer (MUX) 370. The sample/hold circuit 310 receives a first signal VA and a second signal VB, and outputs a first sampled-held voltage SH1 and a second sampled-held voltage SH2.

The first low voltage operational amplifier 330 receives the first sampled-held voltage SH1 and generates a first low pixel voltage LP1, which is within a low-voltage range. The second low voltage operational amplifier 344 receives the second sampled-held voltage SH2 and generates a second low pixel voltage LP2, which is within the low-voltage range. The first multiplexer 350 outputs one of the first low pixel voltage LP1 and the second low pixel voltage LP2 selectively according to a polarity signal POL.

The high voltage operational amplifier 348 connects to the output of the first multiplexer 350 and generates a high pixel voltage HP, which is within a high-voltage range. The second multiplexer 360 selectively outputs one of the first low pixel voltage LP1 and the high pixel voltage HP to a first data line S1 of the display panel according to the polarity signal POL. The third multiplexer 370 selectively outputs one of the second low pixel voltage LP2 and the high pixel voltage HP to a second data line S2 of the display panel according to the polarity signal POL. The polarity signal POL here is determined by the polarity distribution.

Moreover, the first and second low pixel voltages LP1 and LP2 are within the low-voltage range that is lower than a common voltage VCOMREF. The high pixel voltage HP is within the high-voltage range that is higher than the common voltage VCOMREF. The common voltage VCOMREF is the reference voltage to determine the polarity of the pixel voltages.

The sample/hold circuit 310 has a first capacitor device 314 and a second capacitor device 318. The first capacitor device 314 generates the first sampled-held voltage SH1 based on the first signal VA; and the second capacitor device 318 generates the second sampled-held voltage SH2 based on the second signal VB.

The high voltage operational amplifier 348 generates the high pixel voltage HP based on the output from the first multiplexer 350 and the common voltage VCOMREF. Namely, the high pixel voltage HP is generated from one of the first and second low pixel voltages LP1 and LP2, and is higher than the common voltage VCOMREF.

The source driver described above is arranged to drive a display panel. Generally speaking, the source driver has a sample/hold circuit 310 and an amplifier device 390. The sample/hold circuit 310 has the first capacitor device 314 and the second capacitor device 318 described above. The amplifier device 390 selects one of the first sampled-held voltage SH1 and the second sampled-held voltage SH2 to be high-voltage amplified as a high pixel voltage, and selects the other to be low-voltage amplified as a low pixel voltage according to a polarity signal POL. The amplifier device 390 further respectively outputs the low pixel voltage and the high pixel voltage to two data lines S1 and S2 of the display panel according to the polarity signal POL.

The amplifier device 390 has a first multiplexer 350 to select one of the first sampled-held voltage SH1 and the second sampled-held voltage SH2 according to the polarity signal POL. Moreover, the amplifier device 390 also has a high voltage operational amplifier 348 to high-voltage amplify the selected one of the first sampled-held voltage SH1 and the second sampled-held voltage SH2 after selection.

The amplifier device 390 also has low voltage operational amplifiers 330 and 345 to low-voltage amplify the selected other one of the first sampled-held voltage SH1 and the second sampled-held voltage SH2 after selection. The amplifier device 390 has other multiplexers 360 and 370 to output the low pixel voltage and the high pixel voltage to the two data lines S1 and S2 of the display panel selectively according to the polarity signal POL.

These two sample/hold circuits 310 and 310*a*, and two amplifier devices 390 and 390*a* can be used to supply the high pixel voltage and low pixel voltage from three signals VA, VB and VC for four data lines S1, S2, S3 and S4. The three signals VA, VB, and VC are data voltages respectively represent red, green, and blue color. The data lines S1, S2, S3, and S4 are respectively arranged to transmit the data voltages for red, green, blue, and red pixels. The sample/hold circuit 310*a* has the corresponding configuration to the sample/hold circuits 310, and the amplifier devices 390*a* has the corresponding configuration to the amplifier devices 390.

When the data line S1 needs to transmit the data voltage of red color with positive polarity to a pixel, the first signal VA is transmitted to the first low voltage operational amplifier 330 through the sample/hold circuit 310. Since the polarity signal POL is positive, the first multiplexer 350 selects the first sampled-held voltage SH1 for inputting to the high voltage operational amplifier 348. Then, the second multiplexer 360 selects the high pixel voltage HP generated by the high voltage operational amplifier 348 for inputting to the data line S1.

When the data line S3 needs to transmit the data voltage of blue color with negative polarity to a pixel. The third signal VC is transmitted to the first low voltage operational amplifier 330*a* through the sample/hold circuit 310*a*. Since the polarity signal POL is negative, the second multiplexer 360*a* directly selects the low pixel voltage LP1 generated by the first low voltage operational amplifier 330*a* for inputting to the data line S3.

Compared with the conventional source driver in FIG. 1B, the embodiments of this invention each just needs two capacitor devices (first and second capacitor devices) to drive two data lines. Moreover, the embodiments of this invention operate with fewer and lower signals than the conventional source driver. Namely, the conventional source driver operates with three high signals and three low signals, but the embodiments of this invention operate with only three low signals. Therefore, the source drivers of the embodiments can reduce the cost and the power consumption.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A source driver for driving a display panel, the source driver comprising:

a sample/hold circuit with two inputs for receiving a first voltage and a second voltage and two outputs for outputting a first sampled-held voltage and a second sampled-held voltage;

a first multiplexer with two inputs respectively connected to the outputs of the sample/hold circuit, and having two outputs for respectively outputting the first sampled-held voltage and the second sampled-held voltage selectively according to a polarity signal;

a first low voltage amplifier connected to one output of the first multiplexer to output a low pixel voltage;

a high voltage amplifier device connected to the other output of the first multiplexer to output a high pixel voltage; and a second multiplexer for respectively outputting the low pixel voltage and the high pixel voltage to two data lines of the display panel according to the polarity signal;

wherein when the polarity signal is a first value, the first multiplexer is configured to output the first sampled-held voltage to the first low voltage amplifier and to output the second sampled-held voltage to the high voltage amplifier device; and wherein when the polarity signal is a second value, the first multiplexer is configured to output the first sampled-held voltage to the high voltage amplifier device and to output the second sampled-held voltage to the first low voltage amplifier.

2. The source driver as claimed in claim 1, wherein the low pixel voltage is lower than a common voltage.

3. The source driver as claimed in claim 1, wherein the high pixel voltage is higher than a common voltage.

4. The source driver as claimed in claim 1, wherein the sample/hold circuit comprises:

a first capacitor device generating the first sampled-held voltage based on the first voltage; and a second capacitor device generating the second sampled-held voltage based on the second voltage.

5. The source driver as claimed in claim 1, wherein the high voltage amplifier device comprises:

a second low voltage amplifier receiving the output from the first multiplexer; and a high voltage amplifier connecting to the second low voltage amplifier in series to generate the high pixel voltage.

6. The source driver as claimed in claim 5, wherein the high voltage amplifier generates the high pixel voltage based on an output from the second low voltage amplifier and the common voltage.

7. A display comprising:

a display panel; and a source driver for driving a display panel, the source driver comprising:

a sample/hold circuit comprising:

a first capacitor device for generating a first sampled-held voltage based on a first voltage; and a second capacitor device for generating a second sampled-held voltage based on a second voltage; and an amplifier device comprising a first multiplexer, wherein when the polarity signal is a first value, the first multiplexer is configured to output the first sampled-held voltage to be low-voltage amplified as a low pixel voltage and to outputs the second sampled-held voltage to be high-voltage amplified as a high pixel voltage;

wherein when the polarity signal is a second value, the first multiplexer is configured:

to output the first sampled-held voltage to be high-voltage amplified as the high pixel voltage;

to output the second sampled-held voltage to be low-voltage amplified as the low pixel voltage that selects one of the first sampled-held voltage and the second sampled-held voltage to be high-voltage amplified as a high pixel voltage, and to select the other sampled-held voltage to be low-voltage amplified as a low pixel voltage according to a polarity signal; and wherein the amplifier device is further configured to respectively output the low pixel voltage and the high pixel voltage to two data lines of the display panel according to the polarity signal.

8. The display as claimed in claim 7, wherein the amplifier device comprises a high voltage amplifier device to high-voltage amplify the selected one of the first sampled-held voltage and the second sampled-held voltage after selection.

9. The display as claimed in claim 7, wherein the amplifier device comprises a low voltage amplifier device to low-voltage amplify the selected other one of the first sampled-held voltage and the second sampled-held voltage after selection.

10. The display as claimed in claim 7, wherein the amplifier device comprises a second multiplexer to output the low pixel voltage and the high pixel voltage to the two data lines of the display panel selectively according to the polarity signal.

* * * * *